US010588338B2

(12) United States Patent
Hernandez Garcia et al.

(10) Patent No.: US 10,588,338 B2
(45) Date of Patent: Mar. 17, 2020

(54) NONWOVEN COMPOSITE SMOKELESS TOBACCO PRODUCT

(71) Applicant: R.J. Reynolds Tobacco Company, Winston-Salem, NC (US)

(72) Inventors: Ercilia Hernandez Garcia, Clayton, NC (US); Andries Sebastian, Clemmons, NC (US); Randolph Taylor, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 16/456,865

(22) Filed: Jun. 28, 2019

(65) Prior Publication Data

US 2019/0320706 A1 Oct. 24, 2019

Related U.S. Application Data

(63) Continuation of application No. 15/212,837, filed on Jul. 18, 2016, now Pat. No. 10,375,984.

(51) Int. Cl.

| | |
|---|---|
| ***A24B 13/00*** | (2006.01) |
| ***A24B 15/14*** | (2006.01) |
| ***A24B 15/30*** | (2006.01) |
| ***A24B 15/22*** | (2006.01) |
| ***A24B 3/14*** | (2006.01) |
| ***D06M 10/00*** | (2006.01) |
| ***D06M 10/02*** | (2006.01) |
| ***D04H 13/02*** | (2006.01) |
| ***A24B 15/12*** | (2006.01) |

(52) U.S. Cl.

CPC ..... *A24B 15/14* (2013.01); *A24B 3/14* (2013.01); *A24B 13/00* (2013.01); *A24B 15/12* (2013.01); *A24B 15/22* (2013.01); *A24B 15/303* (2013.01); *D04H 13/02* (2013.01); *D06M 10/00* (2013.01); *D06M 10/003* (2013.01); *D06M 10/02* (2013.01)

(58) Field of Classification Search

None

See application file for complete search history.

(56) References Cited

U.S. PATENT DOCUMENTS

| | | | | |
|---|---|---|---|---|
| 1,376,586 A | | 5/1921 | Schwartz | |
| 3,696,917 A | | 10/1972 | Levi | |
| 3,943,945 A | * | 3/1976 | Rosen | A24B 3/14 131/370 |
| 4,182,349 A | * | 1/1980 | Selke | A24B 3/14 131/374 |

(Continued)

FOREIGN PATENT DOCUMENTS

| | | |
|---|---|---|
| WO | WO-2004/095959 | 11/2004 |
| WO | WO-2008/042331 | 4/2008 |
| WO | WO-2010/132444 | 11/2010 |

*Primary Examiner* — Cynthia Szewczyk

(74) *Attorney, Agent, or Firm* — Womble Bond Dickinson (US) LLP

(57) ABSTRACT

A smokeless tobacco product for insertion into the mouth of a user is provided herein. The smokeless tobacco product can be prepared by impregnating a tobacco-containing nonwoven fabric with a second tobacco material, e.g., using at least one alternating electric field. The obtained impregnated tobacco-containing fabric is subsequently bonded to form a composite, which can be further modified in order to obtain desired properties such as moisture content and flavor profile.

21 Claims, 3 Drawing Sheets

(56) References Cited

U.S. PATENT DOCUMENTS

| | | | | |
|---|---|---|---|---|
| 4,270,552 | A * | 6/1981 | Jenkins | A24B 15/12 131/290 |
| 4,513,756 | A | 4/1985 | Pittman et al. | |
| 4,528,993 | A | 7/1985 | Sensabaugh, Jr. et al. | |
| 4,542,755 | A | 9/1985 | Selke et al. | |
| 4,624,269 | A | 11/1986 | Story et al. | |
| 4,821,749 | A | 4/1989 | Toft | |
| 4,987,907 | A | 1/1991 | Townsend | |
| 4,991,599 | A | 2/1991 | Tibbetts | |
| 5,092,352 | A | 3/1992 | Sprinkle, III et al. | |
| 5,387,416 | A | 2/1995 | White et al. | |
| 6,087,465 | A | 7/2000 | Seppälä et al. | |
| 6,109,272 | A | 8/2000 | Saito et al. | |
| 6,668,839 | B2 | 12/2003 | Williams | |
| 6,834,654 | B2 | 12/2004 | Williams | |
| 6,953,040 | B2 | 10/2005 | Atchley et al. | |
| 6,984,631 | B2 | 1/2006 | Aranishi et al. | |
| 7,032,601 | B2 | 4/2006 | Atchley et al. | |
| 7,694,686 | B2 | 4/2010 | Atchley et al. | |
| 7,810,507 | B2 | 10/2010 | Dube et al. | |
| 7,819,124 | B2 | 10/2010 | Strickland et al. | |
| 7,861,728 | B2 | 1/2011 | Holton, Jr. et al. | |
| 7,946,296 | B2 | 5/2011 | Wrenn et al. | |
| 8,067,046 | B2 | 11/2011 | Schleef et al. | |
| 8,151,802 | B2 | 4/2012 | Boldrini | |
| 8,388,780 | B2 | 3/2013 | Caramaro et al. | |
| 8,967,079 | B2 | 3/2015 | Marduel | |
| 9,011,981 | B2 | 4/2015 | Bonin et al. | |
| 2004/0020503 | A1 | 2/2004 | Williams | |
| 2005/0115580 | A1 | 6/2005 | Quinter et al. | |
| 2005/0244521 | A1 | 11/2005 | Strickland et al. | |
| 2006/0191548 | A1 | 8/2006 | Strickland et al. | |
| 2007/0062549 | A1 | 3/2007 | Holton, Jr. et al. | |
| 2007/0261707 | A1 | 11/2007 | Winterson et al. | |
| 2008/0029110 | A1 | 2/2008 | Dube et al. | |
| 2008/0029116 | A1 | 2/2008 | Robinson | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0202536 | A1 | 8/2008 | Torrence et al. | |
| 2008/0305216 | A1 | 12/2008 | Crawford et al. | |
| 2009/0025738 | A1 | 1/2009 | Mua et al. | |
| 2009/0025739 | A1 | 1/2009 | Brinkley et al. | |
| 2009/0065013 | A1 | 3/2009 | Essen et al. | |
| 2009/0293889 | A1 | 12/2009 | Kumar et al. | |
| 2010/0163062 | A1 | 7/2010 | Atchley et al. | |
| 2010/0170522 | A1 | 7/2010 | Sun et al. | |
| 2010/0291245 | A1 | 11/2010 | Gao et al. | |
| 2010/0300463 | A1 | 12/2010 | Chen et al. | |
| 2010/0300464 | A1 | 12/2010 | Gee et al. | |
| 2010/0303969 | A1 | 12/2010 | Sengupta et al. | |
| 2011/0061666 | A1 | 3/2011 | Dube et al. | |
| 2011/0139164 | A1 | 6/2011 | Mua et al. | |
| 2011/0174323 | A1 | 7/2011 | Coleman, III et al. | |
| 2011/0236442 | A1 | 9/2011 | Miser et al. | |
| 2011/0247640 | A1 | 10/2011 | Beeson et al. | |
| 2011/0315154 | A1 | 12/2011 | Mua et al. | |
| 2012/0024301 | A1 | 2/2012 | Carroll et al. | |
| 2012/0031414 | A1 | 2/2012 | Atchley et al. | |
| 2012/0031416 | A1 | 2/2012 | Atchley et al. | |
| 2012/0037175 | A1 | 2/2012 | Cantrell et al. | |
| 2012/0055493 | A1 | 3/2012 | Novak, III et al. | |
| 2012/0055494 | A1 | 3/2012 | Hunt et al. | |
| 2012/0103353 | A1 | 5/2012 | Sebastian et al. | |
| 2012/0118310 | A1 | 5/2012 | Cantrell et al. | |
| 2012/0138073 | A1 | 6/2012 | Cantrell et al. | |
| 2012/0138074 | A1 | 6/2012 | Cantrell et al. | |
| 2012/0192880 | A1 | 8/2012 | Dube et al. | |
| 2013/0186416 | A1 | 7/2013 | Gao et al. | |
| 2013/0186417 | A1 | 7/2013 | Gao et al. | |
| 2013/0186418 | A1 | 7/2013 | Gao et al. | |
| 2013/0186419 | A1 | 7/2013 | Gao et al. | |
| 2014/0083438 | A1 | 3/2014 | Sebastian et al. | |
| 2014/0261472 | A1 | 9/2014 | Carroll et al. | |
| 2015/0128978 | A1 | 5/2015 | Sebastian et al. | |
| 2015/0189910 | A1 | 7/2015 | Sebastian et al. | |
| 2016/0000140 | A1 | 1/2016 | Sebastian et al. | |
| 2016/0073689 | A1 | 3/2016 | Sebastian et al. | |
| 2016/0165953 | A1* | 6/2016 | Goode, Jr. | A24F 23/02 131/352 |

* cited by examiner

NONWOVEN COMPOSITE SMOKELESS TOBACCO PRODUCT

CROSS-REFERENCE TO RELATED APPLICATIONS

This application is a continuation of U.S. application Ser. No. 15/212,837; filed Jul. 18, 2016, and which is incorporated by reference herein in its entirety and for all purposes.

FIELD THE OF INVENTION

The present invention relates to products made or derived from tobacco, or that otherwise incorporate tobacco, and are intended for human consumption. More particularly, the disclosure relates to tobacco products for use in smokeless form.

BACKGROUND OF THE INVENTION

Smokeless tobacco is tobacco that is placed in the mouth and not combusted. There are various types of smokeless tobacco including chewing tobacco, moist smokeless tobacco, snus, and dry snuff.

Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus comprises ground tobacco material that is typically unfermented and incorporated within sealed pouches, whereas dry snuff is finely ground tobacco that is placed in the mouth or used nasally.

See, for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; and U.S. Pat. No. 7,946,296 to Wrenn et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0261707 to Winterson et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; 2009/0293889 to Kumar et al.; 2010/0170522 to Sun et al.; 2010/0291245 to Gao et al.; 2010/0300463 to Chen et al.; 2010/0300464 to Gee et al.; 2010/0303969 to Sengupta et al.; 2011/0061666 to Dube et al.; 2011/0139164 to Mua et al.; 2011/0247640 to Beeson et al.; 2011/0315154 to Mua et al.; 2012/0031414 and 2012/0031416 to Atchley et al.; 2012/0055493 to Novak et al.; 2012/0055494 to Hunt et al.; 2012/0118310 to Cantrell et al.; PCT Pub. Nos. WO 04/095959 to Arnarp et al.; and WO 10/132,444 to Atchley; each of which is incorporated herein by reference. In some examples, pouches or sachets are inserted into the mouth of the user during use, and water soluble components contained within those pouches or sachets are released as a result of interaction with saliva.

Representative smokeless tobacco products that have been marketed include those referred to as CAMEL Snus, CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco, COPENHAGEN Pouches, SKOAL Bandits, SKOAL Pouches, RED SEAL long cut and REVEL Mint Tobacco Packs by U.S. Smokeless Tobacco Company; and MARLBORO Snus and Taboka by Philip Morris USA.

An alternative to smokeless tobacco products in pouch form has been the development of smokeless tobacco formulations comprising polymeric materials. See, for example, US Pat. Pub. Nos. 2012/00831414 to Atchley et al.; 2012/0031416 to Atchley et al.; and 2014/0083438 to Sebastian et al.; each of which is incorporated herein by reference.

It would be desirable to provide an improved process of making composite smokeless tobacco products as well as to improve the means for delivering such composite smokeless tobacco products to provide desirable features, such as ease of dispensing, use, and an overall enjoyable form.

SUMMARY OF THE INVENTION

The present application describes a smokeless tobacco composite, comprising a tobacco-containing fabric modified with a second tobacco material and processes for preparing the same. The tobacco-containing fabric can be made using various techniques including air laying, wet laying, and/or carding methods to generate a nonwoven web of fibers with the desired porosity, thickness, fiber composition (i.e., relative amounts of tobacco fibers versus non-tobacco fibers) and stability (i.e., cohesive or non-cohesiveness). A second tobacco material may be added to the nonwoven web of fibers and impregnation methods may subsequently be used to mix the fibers of the fabric with the second tobacco material. Next, bonding techniques are applied to produce a cohesive smokeless tobacco composite. Additional ingredients may be added at various points during the preparation process to provide a final smokeless tobacco product with desired properties, e.g., mouth feel, flavor profile, etc.

As such, one aspect of the invention is directed to a method for making a smokeless tobacco composite comprising:

depositing a tobacco-containing fabric onto a conveyer, wherein the tobacco-containing fabric comprises a network of tobacco fibers entangled with non-tobacco fibers;

impregnating a second tobacco material in comminuted form into the tobacco-containing fabric such that the second tobacco material is present in an amount of about 5% to about 90% of the total weight of the tobacco-containing fabric to form an impregnated tobacco-containing fabric; and heating the impregnated tobacco-containing fabric to bind the impregnated tobacco-containing fabric and form a smokeless tobacco composite.

In some embodiments, the tobacco-containing fabric has a thickness of about 5 μm to about 5 mm. In certain embodiments, the fibers present in the tobacco-containing fabric have an average diameter of about 1 to about 100 μm. In some embodiments, the second tobacco material is in particulate from with an average diameter smaller than the average diameter of pores in the tobacco-containing fabric In certain embodiment, the fibers present in the tobacco-containing fabric have an average length of about 2 to about 40 mm. In one or more embodiments, the non-tobacco fibers comprise semi-synthetic fibers, synthetic fibers, biodegradable fibers, or combinations thereof. In some embodiments, the biodegradable fibers comprise one or more polymers selected from aliphatic polyesters (such as polyactic acid and polyhydroxyalkanoates), cellulose acetate with imbedded starch particles, cellulose coated with acetyl groups, polyvinyl alcohol, starch, polybutylene succinate, proteins, polysaccharides (e.g., alginate), various starch derivatives, cellulose esters (e.g., cellulose acetate and nitrocellulose) and their derivatives (e.g., celluloid), copolymers and blends thereof. In some embodiment, the non-tobacco fibers comprise synthetic fibers, wherein the synthetic fibers comprise one or more polymers selected from acrylics, nylon, polyester, polyethylene, polypropylene, polyurethane, polyvinyl chloride, and rayon, viscose or other modified cellulosic fibers, and combinations thereof. In some embodiments, the non-tobacco fibers are present in an amount of less than 20% by weight of the total weight of the tobacco-containing fabric.

In one embodiment, the conveyer moves at a speed ranging from about 1 m/min to about 3 m/min.

In some embodiment, the second tobacco material in comminuted form is selected from the group consisting of pelletized, particulate, granular, and shredded tobacco. In some embodiment, the second tobacco material has an average diameter smaller than the average diameter of pores present in the tobacco containing fabric.

In certain embodiments, the impregnating step comprises contacting the second tobacco material with a surface of the tobacco-containing fabric and exposing the tobacco-containing fabric to an alternating electric field.

In some embodiments, the method further comprises treating the tobacco-containing fabric or the impregnated tobacco-containing fabric with an additional component selected from the group consisting of sweeteners, flavorants, fillers, binders, and combinations thereof. In some embodiments, the additional component is a flavorant selected from the group consisting of vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, *eucalyptus*, strawberry, and mixtures thereof. In some embodiments, the additional component is a filler, and the filler is selected from the group consisting of organic fillers, inorganic fillers, and combinations thereof. In some embodiments, the additional component is a sweetener, and the sweetener is selected from the group consisting of natural sweeteners, artificial sweeteners, and combinations thereof.

In some embodiments, the electric field has an alternating voltage with a frequency of about 2 Hz to about 500 Hz and an amplitude of about 100 kV/m to about 80,000 kV/m.

In some embodiments, the impregnated tobacco-containing fabric is heated at a temperature to melt and thermally bond the non-tobacco fibers in the tobacco-containing fabric to generate the smokeless tobacco composite. In some embodiments, the temperature is from about 50 to about 250° C. In some embodiments, the impregnated tobacco-containing fabric is heated using electrically heated surfaces, ultrasonic energy, infrared energy, radio frequency energy, microwave energy, or combinations thereof.

In some embodiments, the method further comprises treating the smokeless tobacco composite with a hydrating liquid to obtain a moisture content ranging between about 5 to about 65% by weight based on the final weight of the smokeless tobacco composite.

Another aspect of the invention is directed to a smokeless tobacco composite comprising a tobacco-containing fabric, wherein the fabric comprises a network of tobacco fibers entangled with non-tobacco fibers, wherein the tobacco-containing fabric is impregnated with a second tobacco material in comminuted form, and wherein the second tobacco material has an average diameter smaller than the average diameter of pores present in the tobacco-containing fabric and wherein the fabric exhibits efficient bulk filling of the second tobacco material in the pores.

In some embodiments, the tobacco-containing fabric comprises tobacco fibers and non-tobacco fibers in a weight ratio ranging from about 10:0.1 to about 0.1:10. In some embodiments, the non-tobacco fibers comprise semi-synthetic fibers, biodegradable fibers, synthetic fibers, or combinations thereof. In some embodiments, the synthetic fibers are present in an amount of less than 20% by weight of the total weight of the tobacco-containing fabric impregnated with the second tobacco material. In some embodiments, the tobacco-containing fabric has a thickness of about 5 μm to about 5 mm.

In some embodiments, all fibers present in the tobacco-containing fabric have an average diameter of about between 1 and about 100 μm. In some embodiments, all fibers present in the tobacco-containing fabric have an average length of about 2 to about 40 mm. In some embodiments, the non-tobacco fibers are biodegradable. In some embodiments, the biodegradable fibers comprise a polymer selected from the group consisting of aliphatic polyesters, cellulose acetate with imbedded starch particles, cellulose coated with acetyl groups, polyvinyl alcohol, starch, polybutylene succinate, proteins, polysaccharides, various starch derivatives, cellulose esters and derivatives, copolymers and blends thereof. In some embodiments, the biodegradable fibers comprise aliphatic esters such as polylactic acid, polyhydroxyalkanoates, or combinations thereof.

In some embodiments, the second tobacco material in comminuted form is selected from the group consisting of pelletized, particulate, granular, and shredded tobacco.

In some embodiments, the smokeless tobacco composite further comprises one or more additional components selected from the group consisting of a sweetener, flavorant, filler, binder, and combinations thereof.

The invention includes, without limitation, the following embodiments.

Embodiment 1

A method for making a smokeless tobacco composite comprising: depositing a tobacco-containing fabric onto a conveyer, wherein the tobacco-containing fabric comprises a network of tobacco fibers entangled with non-tobacco fibers; impregnating a second tobacco material in comminuted form into the tobacco-containing fabric such that the second tobacco material is present in an amount of about 5% to about 90% of the total weight of the tobacco-containing fabric to form an impregnated tobacco-containing fabric; and heating the impregnated tobacco-containing fabric to bind the impregnated tobacco-containing fabric and form a smokeless tobacco composite.

Embodiment 2

The method of any preceding or subsequent embodiment, wherein the tobacco-containing fabric has a thickness of about 5 μm to about 5 mm.

Embodiment 3

The method of any preceding or subsequent embodiment, wherein fibers present in the tobacco-containing fabric have an average diameter of about 1 to about 100 μm.

Embodiment 4

The method of any preceding or subsequent embodiment, wherein fibers present in the tobacco-containing fabric have an average length of about 2 to about 40 mm.

Embodiment 5

The method of any preceding or subsequent embodiment, wherein the non-tobacco fibers comprise semi-synthetic fibers, synthetic fibers, biodegradable fibers, or combinations thereof.

Embodiment 6

The method of any preceding or subsequent embodiment, wherein the non-tobacco fibers comprise biodegradable fibers and wherein the biodegradable fibers comprise one or more polymers selected from the group consisting of aliphatic polyesters selected from the group consisting of polylactic acid, polyhydroxyalkanoates, cellulose acetate with imbedded starch particles, cellulose coated with acetyl groups, polyvinyl alcohol, starch, polybutylene succinate, proteins, polysaccharides, various starch derivatives, cellulose esters and their derivatives, copolymers and blends thereof.

Embodiment 7

The method of any preceding or subsequent embodiment, wherein the non-tobacco fibers comprise synthetic fibers and wherein the synthetic fibers comprise one or more polymers selected from the group consisting of acrylics, nylon, polyester, polyethylene, polypropylene, polyurethane, polyvinyl chloride, and combinations thereof.

Embodiment 8

The method of any preceding or subsequent embodiment, wherein the non-tobacco fibers are present in an amount of less than 20% by weight of the total weight of the tobacco-containing fabric.

Embodiment 9

The method of any preceding or subsequent embodiment, wherein the conveyer moves at a speed ranging from about 1 m/min to about 3 m/min.

Embodiment 10

The method of any preceding or subsequent embodiment, wherein the second tobacco material in comminuted form is selected from the group consisting of pelletized, particulate, granular, and shredded tobacco.

Embodiment 11

The method of any preceding or subsequent embodiment, wherein the second tobacco material is in particulate from with an average diameter smaller than the average diameter of pores in the tobacco-containing fabric.

Embodiment 12

The method of any preceding or subsequent embodiment, wherein the impregnating step comprises contacting the second tobacco material with a surface of the tobacco-containing fabric and exposing the tobacco-containing fabric to an alternating electric field.

Embodiment 13

The method of any preceding or subsequent embodiment, further comprising treating the tobacco-containing fabric or the impregnated tobacco-containing fabric with an additional component selected from the group consisting of sweeteners, flavorants, fillers, binders, and combinations thereof.

Embodiment 14

The method of any preceding or subsequent embodiment, wherein the additional component is a flavorant selected from the group consisting of vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, *eucalyptus*, strawberry, and mixtures thereof.

Embodiment 15

The method of any preceding or subsequent embodiment, wherein the additional component is a filler, and the filler is selected from the group consisting of organic fillers, inorganic fillers, and combinations thereof.

Embodiment 16

The method of any preceding or subsequent embodiment, wherein the additional component is a sweetener, and the sweetener is selected from the group consisting of natural sweeteners, artificial sweeteners, and combinations thereof.

Embodiment 17

The method of any preceding or subsequent embodiment, wherein the electric field has an alternating voltage with a frequency of about 2 Hz to about 500 Hz and an amplitude of about 100 kV/m to about 80,000 kV/m.

Embodiment 18

The method of any preceding or subsequent embodiment, wherein the impregnated tobacco-containing fabric is heated at a temperature to melt and thermally bond the non-tobacco fibers in the tobacco-containing fabric to generate the smokeless tobacco composite.

Embodiment 19

The method of any preceding or subsequent embodiment, wherein the temperature is from about 50 to about 250° C.

Embodiment 20

The method of any preceding or subsequent embodiment, wherein the impregnated tobacco-containing fabric is heated using electrically heated surfaces, ultrasonic energy, infrared energy, radio frequency energy, microwave energy, or combinations thereof.

Embodiment 21

The method of any preceding or subsequent embodiment, further comprising treating the smokeless tobacco composite with a hydrating liquid to obtain a moisture content ranging between about 5 to about 65% by weight based on the final weight of the smokeless tobacco composite.

Embodiment 22

A smokeless tobacco composite comprising: a tobacco-containing fabric, wherein the fabric comprises a network of tobacco fibers entangled with non-tobacco fibers, wherein the tobacco-containing fabric is impregnated with a second tobacco material in comminuted form, and wherein the second tobacco material has a particle size with an average diameter smaller than the average diameter of pores present in the tobacco-containing fabric.

Embodiment 23

The smokeless tobacco composite of any preceding or subsequent embodiment, wherein the tobacco-containing fabric comprises tobacco fiber and non-tobacco fiber in a weight ratio ranging from about 10:0.1 to about 0.1:10.

Embodiment 24

The smokeless tobacco composite of any preceding or subsequent embodiment, wherein the non-tobacco fibers comprise semi-synthetic fibers, biodegradable fibers, synthetic fibers, or combinations thereof.

Embodiment 25

The smokeless tobacco composite of any preceding or subsequent embodiment, wherein the synthetic fibers are present in an amount of less than 20% by weight of the total weight of the tobacco-containing fabric impregnated with the second tobacco material.

Embodiment 26

The smokeless tobacco composite of any preceding or subsequent embodiment, wherein the tobacco-containing fabric has a thickness of about 5 μm to about 5 mm.

Embodiment 27

The smokeless tobacco composite of any preceding or subsequent embodiment, wherein all fibers in the tobacco-containing fabric have an average diameter of about 1 to about 100 μm.

Embodiment 28

The smokeless tobacco composite of any preceding or subsequent embodiment, wherein all fibers in the tobacco-containing fabric have an average length of about 2 to about 40 mm.

Embodiment 29

The smokeless tobacco composite of any preceding or subsequent embodiment, wherein the non-tobacco fibers are biodegradable.

Embodiment 30

The smokeless tobacco composite of any preceding or subsequent embodiment, wherein the biodegradable fibers comprise a polymer selected from the group consisting of aliphatic polyesters, cellulose acetate with imbedded starch particles, cellulose coated with acetyl groups, polyvinyl alcohol, starch, polybutylene succinate, proteins, polysaccharides, starch derivatives, cellulose esters and derivatives, copolymers and blends thereof.

Embodiment 31

The smokeless tobacco composite of any preceding or subsequent embodiment, wherein the biodegradable fibers comprise aliphatic esters selected from polylactic acid, polyhydroxyalkanoates, and combinations thereof.

Embodiment 32

The smokeless tobacco composite of any preceding or subsequent embodiment, wherein the second tobacco material in comminuted is form selected from the group consisting of pelletized, particulate, granular, and shredded tobacco.

Embodiment 33

The smokeless tobacco composite of any preceding or subsequent embodiment, wherein the smokeless tobacco composite further comprises one or more additional components selected from the group consisting of a sweetener, flavorant, filler, binder, and combinations thereof.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

Figure 1:
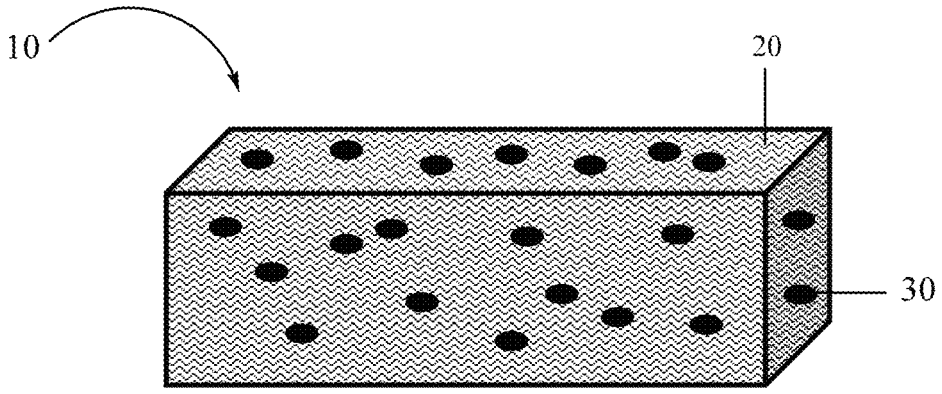
Figure 2:
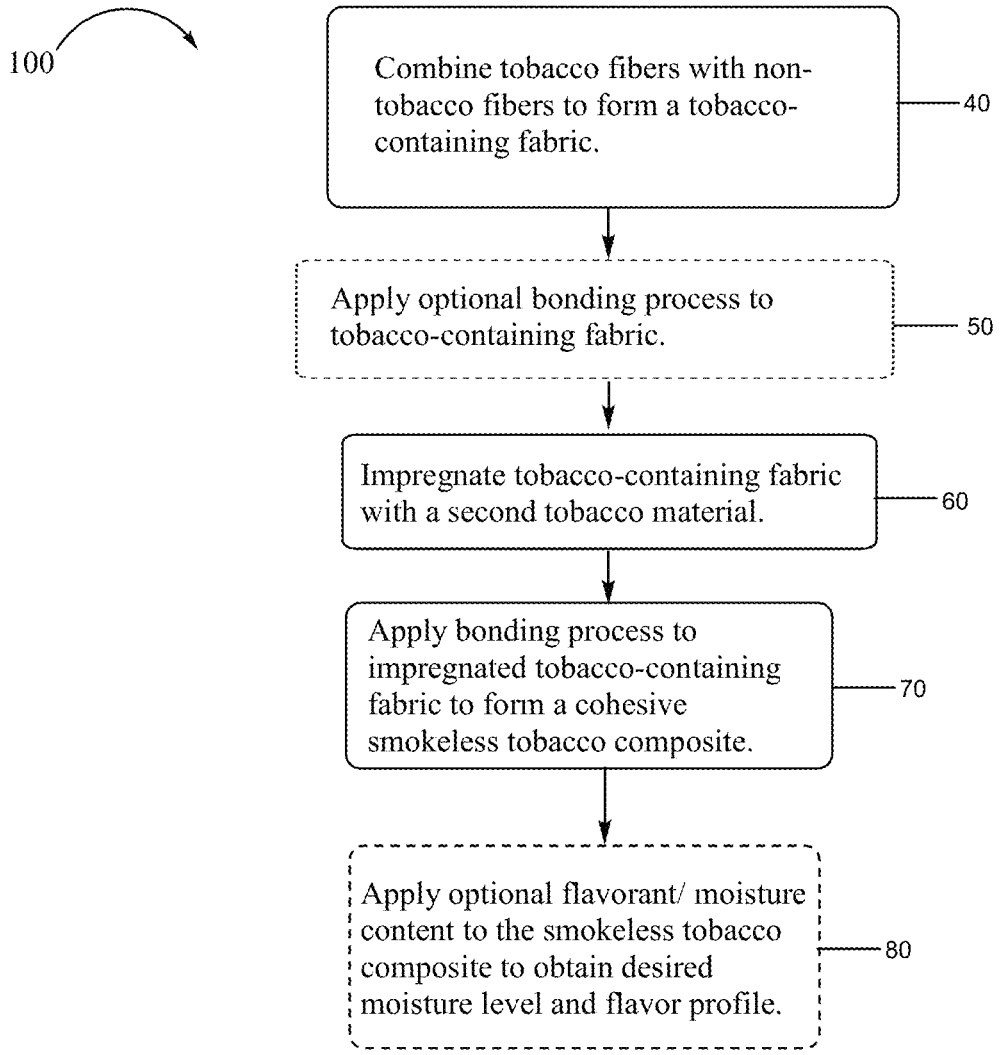
Figure 3:
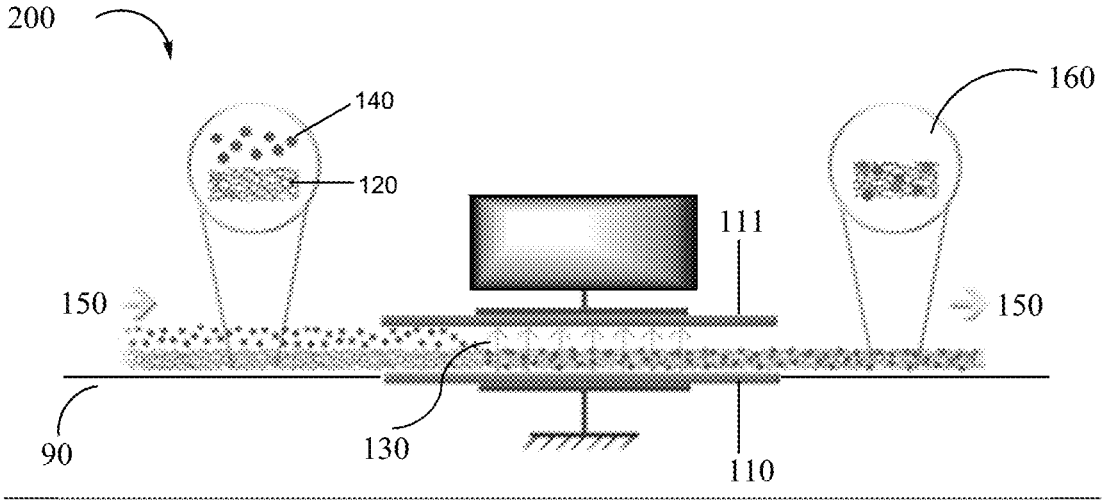

Having thus described the invention in the foregoing general terms, reference will now be made to the accompanying drawings, which are not necessarily drawn to scale, and wherein:

FIG. 1 illustrates an embodiment of a smokeless tobacco composite product according to the invention;

FIG. 2 is a flow chart illustrating the general steps of an exemplary process for the preparation of a smokeless tobacco composite according to the present invention; and FIG. 3 is an illustration showing an exemplary process for the impregnation of a tobacco-containing fabric with a second tobacco material as described in the current application.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise.

The present invention relates to a smokeless tobacco composite and processes for preparing a tobacco-containing fabric impregnated with a second tobacco material suitable for use in such a smokeless tobacco composite. The tobacco-containing fabric can be made using various techniques including air laying, wet laying, and/or carding methods to generate a nonwoven web of fibers with the desired porosity, thickness, fiber composition (e.g., relative amounts of tobacco fibers versus non-tobacco fibers) and stability (i.e., cohesiveness or non-cohesiveness). Impregnation of the second tobacco material into the nonwoven web of fibers is carried out and bonding techniques are applied to the impregnated tobacco-containing fabric to produce a non-cohesive smokeless tobacco composite. Throughout the preparation, additional components may be added to further modify the smokeless tobacco composite according to adult tobacco consumers' preferences such as taste, feel, and duration of experience of the final form.

Composition of Smokeless Tobacco Composite

Typically, the smokeless tobacco composite comprises a tobacco-containing fabric impregnated with a second tobacco material, wherein the tobacco-containing fabric has one type of structural tobacco fiber entangled with at least one type of non-tobacco structural fiber forming a nonwoven network.

The amount of tobacco fiber present in the impregnated tobacco-containing fabric can vary, but will typically be from about 0.1 wt. % to about 90 wt. %, or from about 10 wt. % to about 85 wt. %, or from about 40 wt. % to about 60 wt. % on a dry weight basis relative to the weight of the final impregnated tobacco-containing fabric.

The amount of non-tobacco fiber present in the impregnated tobacco-containing fabric can also vary, but will typically be from about 0.1 wt. % to about 15 wt. %, preferably from about 1 wt. % to about 10 wt. %, even more preferably from about 3 wt. % to about 5 wt. % (i.e., no more than 15 wt. %, no more than 10 wt. %, or no more than 5 wt. %) relative to the weight of the final impregnated tobacco-containing fabric. A typical weight ratio of tobacco fiber to non-tobacco fiber in a nonwoven web is about 10:0.1 to about 0.1:10.

The amount of the second tobacco material present in the impregnated tobacco-containing fabric can vary, but will typically be from about 0.1 wt. % to about 90 wt. %, or from about 1 wt. % to about 85 wt. %, or from about 5 wt. % to about 80 wt. % on a dry weight basis relative to the weight of the final impregnated tobacco-containing fabric.

The tobacco fibers and the second tobacco material are generally derived from tobacco sources such as a plant of the *Nicotiana* species. For example, in some embodiments, the tobacco fibers include reconstituted cellulosic fibers, made from tobacco stems. In certain embodiments, the tobacco material for the second tobacco material is in a form that can be described as particulate, comprising pelletized, particulate, granular, shredded, and/or cut tobacco. Preferably, plant parts or pieces are comminuted, ground or pulverized into a particulate form when used as a second tobacco material using equipment and techniques for grinding, milling, or the like. Most preferably, the plant material is in relatively dry form during grinding or milling, using equipment such as hammer mills, cutter heads, air control mills, or the like. In some embodiments, the second tobacco material particles present in the smokeless tobacco composite have an average diameter ranging from about 0.1 μm to about 3000 μm, preferably from about 0.1 μm to about 1000 μm. In some embodiments, the average diameter of the second tobacco material is smaller than the average diameter of pores present in the tobacco-containing fabric.

The selection of a particular plant from the *Nicotiana* species can vary; and in particular, the type of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos. Additional information on types of *Nicotiana* species suitable for use in the present invention can be found in US Pat. Appl. Pub. No. 2012/0192880 to Dube et al., which is incorporated by reference herein. The portion or portions of the plant of the *Nicotiana* species used according to the present invention can vary. For example, virtually all of the plant (e.g., the whole plant) can be harvested, and employed as such. Alternatively, various parts or pieces of the plant can be harvested or separated for further use after harvest. For example, the leaves, stem, stalk, roots, lamina, flowers, seed, and various portions and combinations thereof, can be isolated for further use or treatment. The plant material of the invention may thus comprise an entire plant or any portion of a plant of the *Nicotiana* species. See, for example, the portions of tobacco plants set forth in US Pat. Appl. Pub. Nos. 2011/0174323 to Coleman, III et al. and 2012/0192880 to Dube et al., which are incorporated by reference herein. The tobacco material can be subjected to various treatment processes such as, refrigeration, freezing, drying (e.g., freeze-drying or spray-drying), irradiation, yellowing, heating, cooking (e.g., roasting, frying or boiling), fermentation, bleaching, or otherwise subjected to storage or treatment for later use. Exemplary processing techniques are described, for example, in US Pat. Appl. Pub. Nos. 2009/0025739 to Brinkley et al. and 2011/0174323 to Coleman, III et al., which are incorporated by reference herein. A harvested portion or portions of the plant of the *Nicotiana* species can be physically processed. In certain embodiments, the tobacco material is used as fibrous structures for web formation with non-tobacco derived fibers to generate a nonwoven network (i.e., tobacco-containing fabric).

In some embodiments, the non-tobacco fiber can be viewed as a "binder fiber," meaning a fiber of any type, size, chemistry, etc. that can be used in combination with another fiber mainly for the purpose of undergoing softening or melting upon heating, such that the binder fiber can act as a binding agent for the other fibers in such a way to impart strength to the resulting fabric. Suitable binding fibers include those made from a thermoplastic polymer that exhibits a melting point in a relatively low range. For example, a binder fiber comprising a thermoplastic polymer can typically have a melting point of about 200° C. or less, about 160° C. or less, about 150° C. or less, about 140° C. or less, or about 120° C. or less. Exemplary thermoplastic polymers include any materials with thermoplastic and/or thermosetting properties. Synthetic fibers with thermoplastic properties include, but are not limited to, fibers comprising polyethylene, poly propylene, polyamides, polyesters, polybutylene terephthalate, polyacetic acid compounds, polyvinyl chloride, polyetherimides, copolyamides, and copolyesters. Synthetic fibers with thermosetting properties include, but are not limited to, fibers comprising unsaturated polyesters or polyepoxides. Additional synthetic fibers which may be used as binder fibers include fibers comprising polymers such as acrylics, nylon, polyethylene, polypropylene, polyurethane (such as DESMOPAN DP 9370A available from Bayer), polyamide 6, polyvinyl chloride, and combinations thereof.

Biodegradable fibers can also be used as binder fibers and include, but are not limited to, aliphatic polyesters (such as polylactic acid and polyhydroxyalkanoates), cellulose acetate with imbedded starch particles, cellulose coated with acetyl groups, polyvinyl alcohol, starch, polybutylene succinate, proteins, polysaccharides (e.g., alginate), various starch derivatives, cellulose esters (e.g., cellulose acetate and nitrocellulose) and their derivatives (e.g., celluloid), copolymers and blends thereof. Additional examples of biodegradable materials include thermoplastic cellulose, available from Toray Industries, Inc. of Japan and described in U.S. Pat. No. 6,984,631 to Aranishi et al., which is incorporated by reference herein, and poly(ester urethane) polymers described in U.S. Pat. No. 6,087,465 to Seppala et al., which is incorporated by reference herein in its entirety.

Exemplary aliphatic polyesters advantageously used in the present invention have the structure—$[C(O)—R—O]_n$—, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight or branched chain. Exemplary aliphatic polyesters include polyglycolic acid (PGA), polylactic acid (PLA) (e.g., poly (L-lactic acid) or poly(DL-lactic acid)), polyhydroxyalkanoates (PHAs) such as polyhydroxypropionate, polyhydroxyvalerate, polyhydroxybutyrate, polyhydroxyhexanoate, and polyhydroxyoctanoate, polycaprolactone (PCL), polybutylene succinate, polybutylene succinate adipate, and copolymers thereof (e.g., polyhydroxybutyrate-co-hydroxyvalerate (PHBV)). In various embodiments, the biodegradable fibers comprise polyhydroxyalkanoate (PHA). In certain embodiments, the PHA can be derived from a material selected from the group consisting of canola oil, tobacco seeds, and combinations thereof.

As used herein, "biodegradable" means a material that meets the requirements of ASTM D6400-04, Standard Specification for Compostable Plastics. Suitable biodegradable materials will decompose in natural aerobic (composting) and anaerobic (landfill) environments, yet remain stable within a consumer's mouth for a suitable period of time (e.g., about 1 hour). Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. U.S. Pat. No. 5,970,988 to Buchanan et al. and U.S. Pat. No. 6,571,802 to Yamashita provide exemplary test conditions for degradation testing. The degradability of a plastic material also may be determined using one or more of the following ASTM test methods: D5338, D5526, D5988, and D6400 noted above.

In some embodiments, non-tobacco structural fibers can be bicomponent or multicomponent fibers, which comprise more than one non-tobacco material or binder fiber component (e.g., synthetic (e.g., polyester/polyolefin), semi-synthetic and/or biodegradable components). Such bicomponent or multicomponent fibers can bind at lower temperature compared to their original individual melting temperature (i.e., when they are not mixed with a second fiber component). For multicomponent fibers, one could have a first fiber component with a first melting point and a second fiber component with a second melting point, wherein the first melting point is lower than the second melting point. In some embodiments, the multicomponent fiber is biodegradable. In certain embodiments, the multicomponent fiber can comprise PLA and/or PHA.

In some embodiments, the binder fiber (e.g., in the form of a synthetic, semi-synthetic, and/or biodegradable fiber) is a food grade fiber.

In some embodiments, such fibers can be colored and/or dyed using a colorant, dye, pigment or combination thereof. For example, the non-tobacco fibers in the tobacco-containing fabric can be dyed in the same color as the second tobacco material to generate a single-colored impregnated tobacco-containing fabric.

In some embodiments, fibers (i.e., tobacco and non-tobacco fibers) in the tobacco-containing fabric have an average length ranging from about 2 nm to about 40 mm, from about 500 □m to about 40 mm, or from about 2 mm to about 40 mm. In some embodiments, the average length of the fibers is less than at least one dimension of the smokeless tobacco composite, e.g., the total length of the smokeless tobacco composite. The total length of the smokeless tobacco composite can vary as described herein. For example, in some embodiments, the smokeless tobacco composite has a rectangular shape with a length ranging from about 20 mm to about 60 mm, or about 40 mm to about 60 mm and in such embodiments, the fibers have lengths that can be within these ranges but less than the exact composite length.

In some embodiments, each fiber (i.e., tobacco and/or non-tobacco) has an average diameter ranging from about 1 to about 500 μm, from about 1 to about 100 μm, or from 1 to about 50 μm.

In some embodiments, the tobacco fibers and non-tobacco fibers are interspersed or layered with each other. For example, a lower melting non-tobacco fiber can function as a binder and is interspersed with the tobacco fiber.

The thickness of the fibrous structures (e.g., tobacco-containing fabric optionally impregnated with a second tobacco material) described herein may vary, but will typically be of sufficient thickness to provide rigidity, strength, and support to the tobacco composition (e.g., smokeless tobacco composite) and to remain intact during oral use. The thickness of the fibrous structures can also depend on the desired taste level or feel within the user's mouth. In some embodiments, the thickness of the fibrous structure can range from about 5 μm to about 5 mm.

In some embodiments, the smokeless tobacco composite can incorporate additional ingredients or components. In some embodiments, these additives could be added to the fibrous structure portion of the composite structure of the invention, such as in the form of a coating or in the form of a material imbedded in the fibrous material (e.g., impregnated). Such additional ingredients or components can be artificial, or can be obtained or derived from herbal or biological sources. Exemplary types of additional components include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), food binder (e.g., pectin), organic and inorganic fillers (e.g., grains, processed grains, puffed grains, maltodextrin, dextrose, calcium carbonate, calcium phosphate, corn starch, lactose, manitol, xylitol, sorbitol, finely divided cellulose, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring and titanium dioxide, and the like), humectants (e.g., glycerin, propylene glycol, and the like), oral care additives (e.g., thyme oil, *eucalyptus* oil, and zinc), preservatives (e.g., potassium sorbate, and the like), syrups (e.g., honey, high fructose corn syrup, and the like), disintegration aids (e.g., microcrystalline cellulose, croscarmellose sodium, crospovidone, sodium starch glycolate, pregelatinized corn starch, and the like), flavorant and flavoring mixtures (e.g., vanilla, coffee, chocolate, cream, mint, spearmint, menthol, peppermint, wintergreen, lavender, cardamom, nutmeg, cinnamon, clove, cascarilla, sandalwood, honey, jasmine, ginger, anise, sage, licorice, lemon, orange, apple, peach, lime, cherry, *eucalyptus*, strawberry, or mixtures thereof), antioxidants, and mixtures thereof. In some embodiments, at least one flavorant is added.

In some embodiments, flavorants and other additives are included in a hydrating liquid. The hydrating liquid optionally includes one or more additives and/or flavorants to moisten the smokeless tobacco composite to the desired final moisture level. The smokeless tobacco composite can have a moisture content of about 5% by weight to about 65% by weight, about 5% by weight to about 30% by weight; about 10% by weight to about 20% by weight; or about 15% by weight to about 25% by weight based on the final weight of the smokeless tobacco composite. In some embodiments, the overall moisture content is 5% by weight or greater, e.g., about 10% by weight or greater; about 25% by weight or greater based on the final weight of the smokeless tobacco composite.

In some embodiments, the amount of each component can vary but will typically be from about 0.1 wt. % to about 10 wt. %, preferably from about 1 wt. % to about 5 wt. %, even more preferably from about 1 wt. % to about 3 wt. % (i.e., no more than 10 wt. %, no more than 5 wt. %, or no more than 3 wt. %) relative to the weight of the final smokeless tobacco composite.

As such, the relative amount of the fibrous structure and the second tobacco material can vary widely depending on the desired properties of the final product. Typically, the fibrous structure will contribute about 1 to about 99% by weight (e.g., about 10% to about 80% by weight) of the final smokeless tobacco composite product. In certain embodiments, the fibrous structure is the predominate component of the final product, such as in the case of products comprising more than about 50% by weight of fibrous structure based on the total weight of the final product (e.g., products containing greater than about 60% by weight or greater than about 70% by weight of the fibrous structure). In some embodiments, the amount of non-tobacco fiber present in such a fibrous structure is less than 20% by weight, less than 15% by weight, less than 10% by weight, or less than 5% by weight based on the total weight of the final product. In certain embodiments, the amount of synthetic fibers present in such a fibrous structure is less than 20% by weight, less than 15% by weight, less than 10% by weight, or less than 5% by weight based on the total weight of the final product. In some embodiments, the tobacco composition is the predominate component, such as in the case of products comprising more than about 50% by weight of tobacco composition based on the total weight of the final product (e.g., products containing greater than about 60% by weight or greater than about 70% by weight of the tobacco composition). In some embodiments, the tobacco-containing fabric is porous to allow particles of the second tobacco material and other components to mix with the tobacco-containing fabric. In certain embodiments, the fabric can has pores, wherein at least some of the pores have a diameter that is greater than the size of the particles (e.g., particles of the second tobacco material and/or other compounds). The space of these pores can optionally be occupied by other particles having a smaller average diameter. For example, in some embodiments, the second tobacco material has an average diameter smaller than the average diameter of pores present in the tobacco-containing fabric. In such embodiments, efficient bulk filling of such particles can be observed. The term "bulk filling" refers to the amount of particles residing in the pores of the fabric.

FIG. 1 provides a sectional view of an embodiment of a smokeless tobacco composite 10 of the present disclosure. As illustrated the tobacco composite includes a tobacco-containing fabric 20, with the second tobacco material 30 is impregnated therein. The impregnated fabric can be molded into a composite according to any desired shape. In some embodiments, the shape of the smokeless tobacco composite can comprise any three dimensional shape (e.g., a wedge, sheet, ellipsoid, barrel cube, cylinder, cube) which provides comfort in the cheek pocket within the mouth of the adult tobacco consumer when using the smokeless tobacco composite.

Methods of Producing Smokeless Tobacco Composites

Smokeless tobacco composites can be made by treating tobacco-containing fabrics with a second tobacco material. An illustrative process 100 is shown in FIG. 2, wherein a tobacco-containing fabric can be generated in step 40 by combining tobacco fibers and non-tobacco fibers using methods such as air laid methods, wet laid methods and/or carding methods. The tobacco-containing fabric generated from step 40 is non-cohesive, meaning the fibers have a certain amount of mobility and can be optionally bonded to form a cohesive web of fibers by applying a bonding process 50. The cohesive or non-cohesive tobacco-containing fabric can now be further modified by contacting the fabric with a second tobacco material and optionally other components such as a flavorant, polymeric material, binder, colorant, fillers, or combinations thereof. In some embodiments, contacting comprises coating the upper face of the tobacco-containing fabric with the second tobacco material. The tobacco-containing fabric is then impregnated with the second tobacco material and any optional components in the presence of an electric field as shown in step 60 and then bonded using bonding process 70 (e.g., a mechanical, chemical/adhesive, or thermal bonding) to generate a cohesive smokeless tobacco composite. In the last step 80, water and optional flavorants are added to the smokeless tobacco composite to afford the final smokeless tobacco product with the desired moisture level and flavor profile.

FIG. 2 serves only as an illustrative process merely describing one embodiment of many embodiments of the current invention and is not meant to limit the scope of the current invention. Descriptions of additional embodiments are provided below.

a. Production of Nonwoven Tobacco-Containing Fabric

Tobacco and non-tobacco fibers can be provided, processed, and/or produced using a number of methods. Typically, the choice of methods for forming webs, e.g., nonwoven fabric, is determined by the fiber length.

In some embodiments, nonwoven materials, e.g., nonwoven tobacco-containing fabrics, are manufactured by taking a staple material made from small fibers, which are combined to form a net or web that can be bound in a number of ways. For example, the staple nonwoven fabric can be made in two steps. First, the fibers are spun, cut to a few centimeters (or inches) in length and baled. In some embodiments, the length of the staple fibers ranges from about 1 to about 6 inches in length. Then, the bales are dispersed on a conveyer belt and the fibers are spread into a uniform web by a dry laid process, an air laid process or by carding. The resulting staple nonwoven fabric is then bound typically by thermal bonding, although other bonding technologies may be used.

One aspect of the invention comprises a tobacco-containing fabric having preformed structural fibers. Preformed structural fibers are synthetic fibers spun in a separate process or obtained commercially. In some embodiments, the preformed structural fibers are used in dry laid nonwoven systems or wet laid nonwoven systems to provide an initial web of structural fibers such as tobacco-containing fabric. This web of structural fibers can be cohesive or non-cohesive. In some embodiments, the web comprises thermoplastic polymer fibers and the web is exposed to heat to melt the thermoplastic polymeric fibers, binding them with the tobacco fibers to form a cohesive web prior to treatment with a second tobacco material. In other embodiments, the web is exposed to heat after treatment with the second tobacco material to melt the thermoplastic polymeric fibers and bind the tobacco material.

A dry laid system can arrange tobacco and non-tobacco fibers into a web typically using two different methods: carding or air-laying. The tobacco and non-tobacco fibers can be about 1.2 to about 100 cm (e.g., 0.47 inches to about 39.37 inches) long. Tobacco fibers are made from natural tobacco, which may be shipped to a manufacturing location in the form of bales of staple fibers. During the carding process a "shredding" effect on the tobacco can often be observed as the material goes through the carding process. Therefore, it is often best to use tobacco with a low number of cuts per inch, e.g., less than 20 cuts per inch. While any tobacco leaf may be cut to the desired amount of cuts per inch, whole large tobacco leaves are most suitable.

During a dry laid process, tobacco and non-tobacco fibers can be mechanically and/or pneumatically processed from a bale to a point where the fibers can be introduced into a web-forming machine. A dry laid process can include the following steps: bale opening; blending; coarse opening; fine opening; and web-form feeding. During these processes, pins can be used to open fiber tufts in preparation for forming a web. Rolls can also reduce the tuft size by using the principle of carding points between the different rolls. The opened fiber with the reduced tufts can be transferred via an air stream to a web-former.

When carding is used as a method of forming a nonwoven fabric, small tufts are separated into individual fiber and begin to parallelize to form into a web. In the carding process, fibers are held by one surface while another surface combs the fibers causing individual fiber separation. A large rotating metallic cylinder covered with card clothing can be used to card tobacco and non-tobacco fibers. The card clothing can include needles, wires, or fine metallic teeth embedded in a heavy cloth or in a metallic foundation. The top of the cylinder may be covered by alternating rollers and stripper rolls in a roller-top card. Needles of the two opposing surfaces of the cylinder and flats or the rollers can be inclined in opposite directions and move at different speeds. The fibers are aligned in the machine direction and form a coherent web below the surface of the needles of the main cylinder. The web can be removed from the surface of cylinder and deposited on a moving belt.

Another dry laid method of forming a nonwoven web can utilize a garnett. Garnetts use a group of rolls placed in an order that allows a given wire configuration, along with certain speed relationships, to level, transport, comb and interlock fibers to a degree that a web is formed. Garnetts can deliver a more random web than carding.

Another dry laid method is called air-laying, where an air-stream is used to orient the tobacco and non-tobacco fibers in the referenced carding or garnetts process. For example, starting with a lap or plied card webs fed by a feed roller, the fibers can be separated by a licker-in or spiked roller and introduced into an air-stream. The air-stream can randomize the fibers as they are collected on a condenser screen. The web can be delivered to a conveyor for transporting to a bonding area. In some embodiments, the length of fibers used in air-laying varies from about 2 to about 6 cm (e.g., about 0.79 inches to about 2.36 inches).

A centrifugal system can also be used to form a nonwoven web by throwing off fibers from the cylinder onto a doffer with fiber inertia, which is subject to centrifugal force. Orientation in the web is three-dimensional and is random or isotropic. In some embodiments, a second tobacco material is added to the centrifugal system to be mixed with the structural fibers.

Web formations can be made into the desired web structure by the layering of the webs from the card and/or garnetts. Layering techniques include longitudinal layering, cross layering, and perpendicular layering. In some embodiments, layers of a second tobacco material are deposited between layers of carded or garneted fibers. As will be discussed below, the nonwoven fabric can be further processed to entangle or interlock the tobacco and non-tobacco fibers of the web with each other and/or with a second tobacco material. This process is called thermal bonding, which is carried out after impregnation of the nonwoven fabric with the second tobacco material.

In a wet laid web process, tobacco and non-tobacco fibers are dispersed in an aqueous medium. Specialized paper machines can be used to separate the water from the fibers to form a uniform sheet of material, which is then bonded and dried. Wet laid nonwoven systems can have high production rate (up to 1000 m/min) and the ability to blend a variety of fibers from papermaking technology. Any natural or synthetic fiber could be used in the production of wet-laid nonwovens. For example, cotton linters, wood pulp, and cellulose structural fibers can be used in wet-laid process. Synthetic fibers (e.g., rayon and polyester) can be used and can provide thermobonding capabilities. Crimped fibers can make a very soft and bulky tobacco-containing fabric. In some embodiments, fibers subjected to a wet-laid process are about 2 mm to 50 mm long.

After swelling and dispersion of the fibers in water, the mixing vats can be transported to the head box from where they are fed continuously into a web-laying machine. Squeezing machines can be used to dehydrate the web. The web can then be dried and bonded. For example, convection, contact and radiation dryers can be used to both dry and bond the web. Bonding agents (e.g., food binders such as pectin) can be added to the wet laid material to help bond the structure. For example, meltable fibers can also be used or added to the web for bonding and are activated by a heating step, e.g., during drying. Examples of fibers of this type include synthetic fibers and biodegradable fibers such as polyester, polyolefin, vinyon, polypropylene, PLA, PHA, cellulose acetate, special low melting polyester or polyamide copolymers, any food grade fiber and combinations thereof.

Once a web has been produced, various bonding technologies may optionally be used to provide an increase in the stability of the nonwoven fabric. In some embodiments, the nonwoven fabric remains non-cohesive. In other embodiments, the nonwoven fabric is made cohesive. Bonding technologies are often used as the last step in the process of producing final tobacco products. However, the nonwoven tobacco-containing fabric does not necessarily have to be bonded as it is not the final tobacco product and is commonly further modified by, e.g., addition of second tobacco materials, thermoplastic polymeric materials, flavorants, fillers, etc. When bonding technologies are used, any suitable method may be employed. Exemplary methods include, but are not limited to mechanical bonding, chemical/adhesive bonding, and thermal bonding.

In mechanical bonding techniques the fibers in the web are bonded together either by felting or fulling using pressure, heat moisture, or by using needles and jets of air and water (e.g., needle punching techniques, stitch bonding, and hydroentanglement).

In chemical/adhesive bonding techniques the fibers in the web are bonded together by a bonding agent. A substance consisting of the same polymer as the fibers or a different polymer is used to create a bond between fibers of the same polymer. The bond is a result of the physical and chemical forces which act on the boundary layer between the two polymers (e.g., saturation adhesive bonding, spray adhesive bonding, foam bonding, application of powders, print bonding, and discontinuous bonding).

Lastly, thermal bonding techniques use heat to bond or stabilize a web structure (e.g., hot calendaring, belt calendering, through-air thermal bonding, ultrasonic bonding, and/or radiant-heat bonding). Various energy sources are applied to increase the temperature of the polymeric material of the structural fibers to bond or attach the structural fibers to each other to create a network of fibers with increased fabric strength and dimensionally stability.

b. Production of Smokeless Tobacco Composites

The nonwoven tobacco-containing fabric produced above can be used as a starting material in the preparation of a smokeless tobacco composite. For example, the tobacco-containing fabric can be coated with a second tobacco material. The second tobacco material can be, for example, tobacco cut filler, granulated tobacco, or shredded tobacco. Various dispensing devices may be used to evenly coat the upper face of the tobacco-containing fabric. Once the tobacco-containing fabric has been coated, the second tobacco material may be "mixed" into the porous nonwoven fabric structure by using various means and/or methods. For example, the coated tobacco-containing fabric may be subjected to vibration, sonication, rocking motion, tilting motion, swaying motion, or combinations thereof. Once the second tobacco material is mixed within the porous structure of the fabric, heat may be applied using various methods to form the final smokeless tobacco composite.

One aspect of the current disclosure involves coating and mixing processes according to the methods described in U.S. Pat. Nos. 8,388,780; 8,967,079; and 9,011,981, which are herein incorporated by reference in their entireties. Equipment used in these coating and mixing methods is available from Fibroline in their D-Preg technology series. As such, a certain method for preparing a smokeless tobacco composite comprises the following:

depositing a tobacco-containing fabric onto a conveyer, wherein the tobacco-containing fabric comprises a network of tobacco fibers entangled with non-tobacco fibers;

impregnating a second tobacco material in comminuted form into the tobacco-containing fabric such that the second tobacco material is present in an amount of about 5% to about 80% of the total weight of the tobacco-containing fabric to form an impregnated tobacco-containing fabric; and heating the impregnated tobacco-containing fabric to bind the impregnated tobacco-containing fabric and form a smokeless tobacco composite.

Generally the entire surface area of the fabric that is to be impregnated is coated with the second tobacco material. In some embodiments, the tobacco-containing fabric is coated on its upper face, wherein the tobacco-containing fabric has a thickness of about 5 μm to about 5 mm. In some embodiments, the tobacco-containing fabric is porous to allow particles, e.g., a second tobacco material, to mix with the fibers present in the tobacco-containing fabric. A dispensing device is used to distribute the second tobacco material uniformly across the fabric at a desired feed rate to obtain a coating with the desired proportion between fabric and smokeless tobacco. In some embodiments, the feed rate ranges from about 100 g/min to about 1,000 g/min, or about 400 to about 800 g/min (or at least about 100 g/min, or at least about 400 g/min). In some embodiments, the advance speed of the conveyer ranges from about 1 to about 3 m/min.

In some embodiments, the method further comprises using at least one additional component other than a second tobacco material to coat the tobacco-containing fabric. For example, in some embodiments at least one component is coated onto the tobacco-containing fabric in a proportion of about 5% to about 90% of the total weight of the modified tobacco-containing fabric. Such component can be organic or inorganic in nature, so as to provide the smokeless tobacco composite with specific properties, e.g., mouth feel, flavor profile, taste, favorable aesthetic appeal, texture, form, etc. In some embodiments, the at least one component comprises a flavorant, binder, sweetener, colorant, filler, salt, pH buffering agent, preservative, polymeric material, liquid food binder (e.g., pectin), or combinations thereof. In some embodiments, the average particle size of such component has a diameter ranging from about 0.1 μm to about 5000 μm, preferably from about 0.1 μm to about 1000 μm, preferably from about 0.1 μm to about 3000 μm. In some embodiments, the average diameter is smaller than the average pore size of the fabric so as to achieve efficient bulk filling. If more than one component is used to coat the fabric, the individual components can be coated at the same time or sequentially. In some embodiments, the components are mixed and coated onto the tobacco-containing fabric at the same time with only one dispensing device. In some embodiments, the components are coated onto the tobacco-containing fabric separately at the same time with more than one dispensing device. In some embodiments the components are coated onto the tobacco-containing fabric sequentially, e.g., components are coated individually onto the fabric at different times.

According to the invention, the mixing step includes subjecting the mixture of tobacco-containing fabric coated with a second tobacco material and optionally with at least one other component to at least one electric field substantially perpendicular to the direction of advance of the conveyor and capable of moving the particles and the tobacco-containing fabric so as to homogenize the mixture.

In other words, the mixing or blending of the powder particles, e.g., second tobacco material, with the fibers within the tobacco-containing fabric is performed by means of at least one electrical field that displaces and agitates the powder particles, and to a lesser extent the fibers, in the direction of the thickness of the nonwoven fabric deposited on the conveyor. Thus, the mixture can be made satisfactorily homogeneous by means of the electrostatic forces that are exerted on the particles and on the fibers, these forces improving the impregnation of the particles between the fibers. The term "substantially perpendicular field" thus means a field in a direction transverse to the conveyor, capable of displacing the powder particles in the thickness of the nonwoven fabric. To do this, the field should have a component that is perpendicular to the conveyor.

In some embodiments, the electric field has an alternating voltage of sinusoidal form, typically a frequency of about 50 Hz being used. However, in some embodiments the electrical field may have an alternating voltage with a frequency of between about 2 Hz and about 500 Hz and an amplitude of between about 100 kV/m and about 80 000 kV/m. Such an electrical field can allow efficient blending of the powder particles in the middle of the fibers. Specifically, an alternating field can cause oscillating displacements of the particles, which has a tendency to efficiently homogenize the mixture.

After mixing (i.e., impregnation) of the tobacco-containing material with the second tobacco material has occurred, the material is heated. The heating of the impregnated tobacco-containing fabric allows for the fabric to form the smokeless tobacco composite. Generally, the thermoplastic polymeric material(s) present in the fabric is melted in order to form, after cooling, the matrix of a composite material that is reinforced by the fibers of the fabric and ensures the cohesion of fibers joined together and densely entangled. This process is often referred to as "thermal bonding" and can optionally be applied after web formation of the initial tobacco-containing fabric as described earlier and/or upon forming the final smokeless tobacco composite.

In general, thermal bonding uses heat to bond or stabilize a web structure such as a tobacco-containing fabric, wherein polymeric structural fibers are thermally bonded to stabilize the tobacco-containing fabric. In some embodiments of thermal bonding, energy sources are applied to increase the temperature of the polymeric material of the structural fibers and to bond or attach the structural fibers to each other to create a network of fibers with increased fabric strength and dimensionally stability. For example, electrically heated surfaces, ultrasonic bonding, infrared energy, radio frequency energy and microwave energy are exemplary sources of energy for thermal bonding.

Bonding between the structural fibers is accomplished by incorporating a low melting temperature polymer into the network of structural fibers. For example, the low melting temperature polymer could be introduced into the network in the form of fibers, beads, sprinkled particles or random shapes. The low melting temperature polymer fibers, beads, sprinkled particles or random shapes can be dispersed within the network of structural fibers of the fabric. In some embodiments, the low melting temperature polymer has a melting point of between about 50° C. and 250° C. For example, low molecular weight synthetic fibers (e.g., polyethylene and polypropylene) can be used as the low melting temperature polymer. In some embodiments, biodegradable material with a low melting point can be used such as PLA and/or PHA fibers. In other embodiments, the low melting temperature polymer can be polyvinyl acetate or various polymeric waxes. By heating the composite of the structural fibers, the second tobacco material, and the low melting temperature polymeric material to a temperature between the melting points of all the other materials present, the low melting temperature polymeric material can be selectively melted and thus bond to surrounding fibers to create a desired level of bonding within the impregnated tobacco-containing fabric. The heating process can function to lock in the added second tobacco material (e.g., comminuted material) into the tobacco-containing fabric to ensure, in some embodiments, complete cohesiveness of the tobacco modified tobacco-containing fabric.

The solidified composite is then moistened with water and can optionally contain flavors to obtain a smokeless tobacco composite with the desired final moisture level and/or flavor profile.

FIG. 3 illustrates an exemplary production line 200 of making a smokeless tobacco composite according to the present invention. In this production line, a conveying device 90 consists of a conventional conveyor whose belt advances in the direction indicated by the arrow 150.

A tobacco-containing fabric 120 is deposited on the conveyor belt 90. In some embodiments, the layer has a thickness of about 5 μm to about 5 mm. The tobacco-containing fabric 120 in this case advances according to the speed of the conveyor 90. In some embodiments, the conveyor is set at an advance speed of about 2 m/min.

Next, the nonwoven fabric 120 is coated with particles 140 of a powder comprising of one or more materials, e.g., tobacco materials, thermoplastic polymeric materials, flavorants, fillers, binder, colorants, etc. The particles 140 are deposited on the nonwoven fabric 120 simply by the effect of gravity. A dispensing device 71 (not shown) meters the feed rate of these powder particles 140 synchronously with the advance 150 of the conveyor 90. In some embodiments, more than one material is coated onto nonwoven fabric 120 at the same time using the same coating device 71. The dispensing device 71 operates at a feed rate that makes it possible to obtain the desired proportion between nonwoven fabric 120 and powder particles 140.

In some embodiments, the ratio of the mass of the powder particles 140 relative to the total weight of the nonwoven fabric 120 is about 20% to about 80%, preferably about 40% to about 60%. This mass ratio is determined as a function of the weight per unit area or basis weight desired for the final smokeless tobacco composite. The weight per unit area of the final smokeless tobacco composite obtained according to the above process may range from about 50 g/m$^2$ to about 10 000 g/m$^2$.

Typically, the characteristic parameters of the process such as the feed rate of the distributed particles, the speed of advance of the conveyor, etc. are determined as a function of the respective mixed proportions and masses per unit volume of the tobacco-containing fabric and of the constituent materials of the powders, e.g., second tobacco material, so as to obtain the basis weight desired for the product, generally of about 50 g/m$^2$ to about 5000 g/m$^2$.

The next step comprises mixing the fibers present in the nonwoven fabric 120 with the powder particles 140 so as to impregnate the fabric 120 homogeneously with the powder particles 140 to generate impregnated tobacco-containing fabric 160. To do this, the mixture of the fibers in nonwoven fabric 120 with the powder particles 140 is subjected to an electric field 130 generated between electrodes 110 and 111, which are globally flat and mutually parallel. The powder particles 140 and the fibers of nonwoven fabric 120 are then placed in motion, globally along the field lines.

Specifically, in a known manner in the field of electrostatic powdering, an electric field ionizes the dioxygen molecules of the air, which become charged. These charged oxygen species become bound to the powder particles, of which the charge thus formed depends on the dielectric permittivity of the material constituting them. This is why it is preferable to use low-conducting plastics in order to satisfactorily place the powders in motion. However, conductive fillers may be used as a mixture or during a subsequent coating. Once the particles are charged they can be attached to the nonwoven fabric via exposure to an electric field.

As a function of the weight per unit area, or basis weight, desired for the final smokeless tobacco composite, the electrodes 110 and 111 must be spaced apart by a distance of 0.5 mm to about 70 mm. To prepare a homogeneous mixture between the fibers in nonwoven fabric 120, which are electrically non-conductive, and the powder particles 140, an electric field with an alternating voltage of sinusoidal form, the frequency of which is 50 Hz, is used. Furthermore, the electric field generated in the example illustrated by the FIG. 1 has an amplitude of about 10 000 kV/m.

Such characteristics of the electric field make it capable of moving the particles 140 and the fibers in nonwoven fabric 120. When such an electric field is applied between the electrodes 110 and 111, not only the particles 140, but also, to a lesser extent, the fibers in nonwoven fabric 120 can be placed in motion. The reason for this is that the fibers in nonwoven fabric 120, which are chopped are in some embodiments not yet bound together (e.g., have optionally not been exposed to a heat source), and as such they are capable of moving under the effect of the electric field 130 generated between the electrodes 110 and 111.

The next step is a heat treatment step, which is standard in processes for manufacturing smokeless tobacco composites. In general, such a heat treatment is accompanied or followed by pressing of the smokeless tobacco composites. The combination of these heat treatment and pressing steps is often referred to as "calendering". Typically, the heating temperatures during the calendering step may range from about 50° C. to about 400° C. depending on the nature of the materials used. Thus, for example, heating above about 160° C. must be performed to reach the melting point of polypropylene and beyond 180° C. to reach that of polylactic acid, or beyond 220° C. to reach that of polyamide 6.

The optional step of pressing serves to conform the products to the final thickness and three dimensional shapes desired for the smokeless tobacco composites product.

Finally, the solidified composite can be moistened with a hydrating liquid and can optionally contain flavors to obtain a smokeless composite with the desired moisture level and flavor profile. For example, the smokeless tobacco composite can have a moisture content of between about 5 and about 65% by weight, between about 5% by weight to about 30% by weight; between about 10% by weight to about 20% by weight; between about 15% by weight to about 25% by weight based on the final weight of the smokeless tobacco composite.

Products of the present invention may be packaged and stored in any suitable packaging. See, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; U.S. Pat. No. 7,946,450 to Gelardi et al.; U.S. Pat. No. 8,033,425 to Gelardi; U.S. Pat. No. 8,066,123 to Gelardi; U.S. Pat. No. D592,956 to Thiellier; U.S. Pat. No. D594,154 to Patel et al.; and U.S. Pat. No. D625,178 to Bailey et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0230003 to Thiellier; 2010/0084424 to Gelardi; 2010/0133140 to Bailey et al; 2010/0264157 to Bailey et al.; 2011/0168712 to Gelardi et al.; and 2011/0204074 to Bailey et al., which are incorporated herein by reference. Various manners or methods for packaging smokeless tobacco compositions are also set forth in US Patent Pub. Nos. 2004/0217024 and 2006/0118589 to Arnarp et al.; and 2009/0014450 to Bjorkholm; and PCT Pub. Nos. WO 2006/034450 to Budd; WO 2007/017761 to Kutsch et al.; and WO 2007/067953 to Sheveley et al, which are incorporated by reference herein.

EXPERIMENTAL

Example 1: Preparation of Nonwoven Tobacco Batt Using Air Laid Methods

The desired weight ratio of non-tobacco fibers to tobacco fibers is weighed out using a scale. The tobacco fibers have approximately 20% moisture and are cut to 20 CPI (Cuts per inch) from whole tobacco leaves, while the selection of the non-tobacco nonwoven fibers will vary depending on the fibers chosen. The non-tobacco nonwoven fibers are mixed with the tobacco fibers using a hand mixer. Next, the fiber mix is introduced to an air stream column above a condenser screen. The airstream will aid in further orienting and mixing the fibers. The fiber mix is allowed to settle on the condenser screen to create a loose nonwoven tobacco batt. Subsequently, the batt on the condenser screen is moved to an oven to be thermally bonded. The oven is preheated to the melting temperature of the non-tobacco nonwoven fibers before placing the batt in the oven. Then, the batt is removed from the oven after the non-tobacco nonwoven fibers have softened, melted, and bonded together. The batt is now ready for a secondary process to add more tobacco or enhance the flavor profile of the finished oral tobacco product.

Example 2: Preparation of Nonwoven Tobacco Batt Using Carding Methods

The desired weight ratio of non-tobacco fibers to tobacco fibers is weighed out using a scale. The tobacco fibers have approximately 20% moisture and are cut to 20 CPI (Cuts per inch) from whole tobacco leaves, while the selection of the non-tobacco nonwoven fibers will vary depending on the fibers chosen. The non-tobacco nonwoven fibers and the tobacco fibers are introduced onto a conveyer belt on a carding machine. As the fibers move through the carding machine, the fibers will be mixed together. Carding can have a "shredding" effect on the tobacco as it runs through the carding process. For best results, tobacco with a low number of cuts per inch (less than 20 cuts per inch) is used. While any tobacco cut filler may be cut to the desired amount of cuts-per-inch, it was found that whole tobacco leaves are most suitable. Next, the batt is collected from the conveyer belt at the end of the carding machine. The batt is then moved to an oven to be thermally bonded. The oven is preheated to the melting temperature of the non-tobacco nonwoven fibers before placing the batt in the oven. The batt is then removed from the oven after the non-tobacco nonwoven fibers have softened, melted, and bonded together. The batt is now ready for a secondary process to add more tobacco or enhance the flavor profile of the finished oral tobacco product.

Example 3: Preparation of Nonwoven Tobacco Batt Using Wet Laid Methods

The desired weight ratio of non-tobacco fibers to tobacco fibers is weighed out using a scale. The tobacco fibers have approximately 20% moisture and are cut to 100 CPI (Cuts per inch) from tobacco cut filler, while the selection of the non-tobacco nonwoven fibers will vary depending on the fibers chosen. The non-tobacco nonwoven fibers, the tobacco fibers, and water are mixed together in a blender. Any excess water will be drained, so plenty of water is used in this step and all three components in the blender are evenly mixed. The resulting aqueous fiber mix is introduced into a water column above a condenser screen. The fibers are allowed to settle to the bottom and the water is allowed to drain through the condenser screen. When most of the water has been drained by gravity, a vacuum is turned on to remove excess water in the batt. Excess water can also be removed by adding pressure (squeezing out the water) to the batt on the condenser screen. The batt is moved on the condenser screen to an oven to be thermally bonded. The oven is preheated to the melting temperature for the non-tobacco nonwoven fibers before the batt is placed in the oven. The batt is removed from the oven after the non-tobacco nonwoven fibers have softened, melted, and bonded together. The batt is now ready for a secondary process to add more tobacco or enhance the flavor profile of the finished oral tobacco product.

Example 4: Preparation of Impregnated Nonwoven Tobacco-Containing Fabric

The tobacco nonwoven batt material prepared in Examples 1-3 is used as a starting material and impregnated with a second tobacco material according to the process illustrated in FIG. 3. According to this process, the nonwoven batt material is placed on a conveyer belt, which moves at a speed ranging from about 1 m/min to about 3 m/min.

Next, a second tobacco material, i.e., cut tobacco filler, is applied to coat the upper face of the tobacco batt material lying on the conveyer belt. Next, impregnation of the nonwoven batt material with the second tobacco material occurs upon exposure of the coated nonwoven batt material to an electric field, which has an alternating voltage of sinusoidal form with a frequency of about 50 Hz. The impregnation step provides the impregnated tobacco-containing batt, wherein the amount of second tobacco material present in the batt is about 80% by weight.

What is claimed:

1. A method for making a smokeless tobacco composite comprising:

depositing a tobacco-containing fabric onto a conveyer, wherein the tobacco-containing fabric comprises a network of tobacco fibers entangled with non-tobacco fibers;

impregnating a second tobacco material in comminuted form into the tobacco-containing fabric such that the second tobacco material is present in an amount of about 5% to about 90% of the total weight of the tobacco-containing fabric to form an impregnated tobacco-containing fabric; and heating the impregnated tobacco-containing fabric to bind the impregnated tobacco-containing fabric and form a smokeless tobacco composite, wherein the tobacco fibers, the second tobacco material in comminuted form, or both, comprise bleached tobacco.

2. The method of claim 1, wherein fibers present in the tobacco-containing fabric have an average diameter of about 1 to about 100 μm.

3. The method of claim 1, wherein fibers present in the tobacco-containing fabric have an average length of about 2 to about 40 mm.

4. The method of claim 3, wherein the non-tobacco fibers comprise biodegradable fibers and wherein the biodegradable fibers comprise one or more polymers selected from the group consisting of aliphatic polyesters selected from the group consisting of polylactic acid, polyhydroxyalkanoates, cellulose acetate with imbedded starch particles, cellulose coated with acetyl groups, polyvinyl alcohol, starch, polybutylene succinate, proteins, polysaccharides, various starch derivatives, cellulose esters and their derivatives, copolymers and blends thereof.

5. The method of claim 3, wherein the non-tobacco fibers comprise synthetic fibers and wherein the synthetic fibers comprise one or more polymers selected from the group consisting of acrylics, nylon, polyester, polyethylene, polypropylene, polyurethane, polyvinyl chloride, and combinations thereof.

6. The method of claim 1, wherein the non-tobacco fibers are present in an amount of less than 20% by weight of the total weight of the tobacco-containing fabric.

7. The method of claim 1, wherein the second tobacco material is in particulate form with an average diameter smaller than the average diameter of pores present in the tobacco-containing fabric.

8. The method of claim 1, wherein the impregnating step comprises contacting the second tobacco material with a surface of the tobacco-containing fabric and exposing the tobacco-containing fabric to an alternating electric field.

9. The method of claim 8, wherein the electric field has an alternating voltage with a frequency of about 2 Hz to about 500 Hz and an amplitude of about 100 kV/m to about 80,000 kV/m.

10. The method of claim 1, further comprising treating the tobacco-containing fabric or the impregnated tobacco-containing fabric with an additional component selected from the group consisting of sweeteners, flavorants, fillers, binders, and combinations thereof.

11. The method of claim 1, wherein the impregnated tobacco-containing fabric is heated at a temperature to melt and thermally bond the non-tobacco fibers in the tobacco-containing fabric to generate the smokeless tobacco composite.

12. The method of claim 11, wherein the temperature is from about 50 to about 250° C.

13. The method of claim 1, further comprising treating the smokeless tobacco composite with a hydrating liquid to obtain a moisture content ranging between about 5 to about 65% by weight based on the final weight of the smokeless tobacco composite.

14. A smokeless tobacco composite comprising a tobacco-containing fabric, wherein:

the tobacco-containing fabric comprises a network of tobacco fibers entangled with non-tobacco fibers;

the tobacco-containing fabric is impregnated with a second tobacco material in comminuted form;

the second tobacco material has a particle size with an average diameter smaller than the average diameter of pores present in the tobacco-containing fabric; and the tobacco fibers, the second tobacco material in comminuted form, or both, comprise bleached tobacco.

15. The smokeless tobacco composite of claim 14, wherein the tobacco-containing fabric comprises tobacco fiber and non-tobacco fiber in a weight ratio ranging from about 10:0.1 to about 0.1:10.

16. The smokeless tobacco composite of claim 14, wherein the non-tobacco fibers are present in an amount of less than 20% by weight of the total weight of the tobacco-containing fabric impregnated with the second tobacco material.

17. The smokeless tobacco composite of claim 14, wherein all fibers present in the tobacco-containing fabric have an average diameter of about 1 to about 100 μm.

18. The smokeless tobacco composite of claim 14, wherein all fibers present in the tobacco-containing fabric have an average length of about 2 to about 40 mm.

19. The smokeless tobacco composite of claim 14, wherein the non-tobacco fibers are biodegradable.

20. The smokeless tobacco composite of claim 19, wherein the biodegradable fibers comprise a polymer selected from the group consisting of aliphatic polyesters, cellulose acetate with imbedded starch particles, cellulose coated with acetyl groups, polyvinyl alcohol, starch, polybutylene succinate, proteins, polysaccharides, various starch derivatives, cellulose esters and derivatives, copolymers and blends thereof.

21. The smokeless tobacco composite of claim 20, wherein the biodegradable fibers comprise aliphatic esters such as polylactic acid, polyhydroxyalkanoates, or combinations thereof.

* * * * *